US009511507B2

(12) United States Patent
Schnell et al.

(10) Patent No.: US 9,511,507 B2
(45) Date of Patent: Dec. 6, 2016

(54) PORTABLE POWER TOOL

(75) Inventors: Pascal Schnell, Baerschwil (CH); Hermann Schaible, Biberist (CH)

(73) Assignee: Robert Bosch GmbH, Stuttgart (DE)

( * ) Notice: Subject to any disclaimer, the term of this patent is extended or adjusted under 35 U.S.C. 154(b) by 1126 days.

(21) Appl. No.: 13/606,078

(22) Filed: Sep. 7, 2012

(65) Prior Publication Data

US 2013/0240087 A1 Sep. 19, 2013

(30) Foreign Application Priority Data

Sep. 7, 2011 (DE) ..... 10 2011 082 275

(51) Int. Cl.
*B27C 5/10* (2006.01)

(52) U.S. Cl.
CPC ..... *B27C 5/10* (2013.01)

(58) Field of Classification Search
CPC ..... B27C 5/10; B27C 1/005; B27C 1/02; B27C 1/14; B27C 7/00; B27C 7/04; B27C 7/06; B25H 1/0042; B23Q 9/0007; B23Q 9/0014; B23Q 9/0028; Y10T 409/306384; Y10T 409/306496
See application file for complete search history.

(56) References Cited

U.S. PATENT DOCUMENTS 5,191,921 A * 3/1993 McCurry ..... B23Q 16/001 144/136.95
6,065,912 A * 5/2000 Bosten ..... B27C 5/10 144/136.95
7,524,150 B2 * 4/2009 Zaiser ..... B27C 5/10 144/136.95

FOREIGN PATENT DOCUMENTS

| | | | |
|---|---|---|---|
| CN | 1775486 | A | 5/2006 |
| CN | 1894072 | A | 1/2007 |
| CN | 101337346 | A | 1/2009 |
| EP | 1 897 662 | A1 | 3/2008 |
| JP | 2011-11300 | A | 1/2011 |

* cited by examiner

*Primary Examiner* — Matthew G Katcoff
(74) *Attorney, Agent, or Firm* — Maginot, Moore & Beck LLP

(57) ABSTRACT

A portable power tool includes at least one seating unit configured to seat on a workpiece, at least one housing unit mounted so as to be movable relative to the seating unit, and at least one movement delimitation unit that has at least one movement delimitation element configured to set a length of a movement travel of the housing unit relative to the seating unit. The portable power tool further includes at least one decoupling unit configured, in at least one operating state, to decouple the movement delimitation unit from a movement of the housing unit when the movement delimitation element is in a fixed state. The decoupling of the movement delimination unit occurring at least in the case of a movement of the housing unit in the direction of the seating unit.

9 Claims, 2 Drawing Sheets

PORTABLE POWER TOOL

This application claims priority under 35 U.S.C. §119 to patent application no. DE 10 2011 082 275.5, filed on Sep. 7, 2011 in Germany, the disclosure of which is incorporated herein by reference in its entirety.

BACKGROUND

There are already known portable power tools, in particular routers, that comprise a seating unit for seating on a workpiece, a housing unit, which is mounted so as to be movable relative to the seating unit, and a movement setting unit, which has at least one movement delimitation element for setting a length of a movement travel of the housing unit relative to the seating unit.

SUMMARY

The disclosure is based on a portable power tool, in particular a router, comprising at least one seating unit for seating on a workpiece, and comprising at least one housing unit, which is mounted so as to be movable relative to the seating unit, and comprising at least one movement setting unit, which has at least one movement delimitation element for setting a length of a movement travel of the housing unit relative to the seating unit.

It is proposed that the portable power tool comprises at least one decoupling unit provided, in at least one operating state, to decouple the movement setting unit from a movement of the housing unit when the movement delimitation element is in a fixed state, at least in the case of a movement of the housing unit in the direction of the seating unit. A "portable power tool" is to be understood here to mean, in particular, a power tool, for machining of workpieces, that can be transported by an operator without a transport machine. "Provided" is to be understood to mean, in particular, specially designed and/or specially equipped. The portable power tool has, in particular, a mass of less than 40 kg, preferably less than 10 kg, and particularly preferably less than 5 kg. Particularly preferably, the portable power tool is realized as a router. It is also conceivable, however, for the portable power tool to be of a different design, considered appropriate by persons skilled in the art. A "seating unit" is to be understood here to mean, in particular, a unit that, during machining of a workpiece by means of the portable power tool, the portable power tool being handled in the correct manner, is seated on the workpiece, in particular with a seating surface of the seating unit, and which is provided to support the portable power tool on the workpiece during machining of the workpiece. Particularly preferably, the seating unit is realized as a sliding pad and/or as a base plate.

Particularly preferably, the housing unit is mounted so as to be movable in a linear manner, relative to the seating unit, along a lifting axis of the portable power tool. The housing unit in this case is preferably realized as a motor housing unit or as a milling basket. The motor housing unit can be of a pot-type construction or a shell-type construction. Preferably, the motor housing unit is of a pot-type construction or is a combination of a pot-type construction and a shell-type construction, wherein at least two handle shells are connected to each other by means of connecting elements such as, for example, screws, along a connecting plane that extends through a vertical axis of the portable power tool, in particular a lifting axis of the portable power tool. The movement delimitation unit is preferably provided for setting a length of a movement travel of the housing unit relative to the seating unit, along the lifting axis in the direction of the seating unit. Thus, preferably, by means of the movement delimitation unit it is possible to set a cutting depth of an insert tool disposed in a tool receiver of the portable power tool.

The decoupling unit is preferably provided, by means of a mechanism, when the movement delimitation element is in a fixed state, to enable a movement of the housing unit relative to the movement delimitation unit, in particular in an operating state in which the movement delimitation element bears against a stop element of the movement delimitation unit that is disposed on the seating unit. Preferably, the decoupling unit is provided to enable movements of the housing unit relative to the movement delimitation unit and relative to the seating unit, along the lifting axis in the direction of the seating unit and in a direction facing away from the seating unit, when the movement delimitation element is bearing against the stop element disposed on the seating unit. The housing unit in this case can be moved, in particular, relative to the movement delimitation unit and relative to the seating unit, along a distance greater than 0.1 mm, preferably greater than 1 mm, and particularly preferably greater than 5 mm. The design according to the disclosure makes it possible, advantageously, to achieve a precise and convenient setting of a cutting depth, in particular a milling depth, of the portable power tool. Advantageously, setting errors following zeroizing of a setting of a length of a movement travel of the housing unit relative to the seating unit can be kept few in number and, particularly advantageously, these errors can be prevented.

Furthermore, it is proposed that the portable power tool comprises at least one position fixing unit, which has at least one shift element, on which there is disposed at least one fixing element for fixing a position of the housing unit relative to the seating unit, the movement delimitation element being movably mounted on the shift element. The expression "movably mounted" is intended here to define, in particular, a mounting of the movement delimitation element on the shift element, wherein the movement delimitation element, in particular decoupled from an elastic deformation of the movement delimitation element, has a capability to move relative to the shift element, along at least one axis along a travel distance greater than 1 mm, preferably greater than 10 mm, and particularly preferably greater than 20 mm. Alternatively or additionally, however, it is also conceivable for the movement delimitation element to have a different movement capability, considered appropriate by persons skilled in the art, such as, for example, a capability to move about at least one axis, by an angle greater than 10°, preferably greater than 45°, and particularly preferably greater than 60°. Decoupling of a movement of the housing unit relative to the movement delimitation unit can be achieved in a structurally simple manner in the case of the movement delimitation element bearing against the stop element disposed on the seating unit.

Preferably, the portable power tool comprises at least one fine setting unit, which has at least one fine setting element that acts in combination with a movement transforming element of the position fixing unit for the purpose of moving the housing unit relative to the seating unit as a result of an actuation of the fine setting element. A "fine setting unit" is to be understood here to mean, in particular, a unit provided to set a distance of the housing unit relative to the seating unit, along the lifting axis, by means of a transforming unit, the transforming unit being provided to transform a large actuation travel of a control element of the fine setting unit that can be actuated by an operator into a small movement travel of the housing unit relative to the seating unit. The transforming unit in this case can be realized as a threaded unit, as an eccentric transmission unit or as another transforming unit considered appropriate by persons skilled in the art. Preferably, upon a rotation of the control element along an angle of 360° about a rotation axis of the control element, the housing unit is changed by less than 5 mm, preferably by less then 3 mm, and particularly preferably by more than 1 mm. Advantageously, a length of a movement travel of the housing unit relative to the seating unit can be readjusted, decoupled from an actuation of the movement delimitation unit. A cutting depth, in particular a milling depth, can thus be set with precision, advantageously, to 0.1 mm.

Further, it is proposed that the movement transforming element has at least one thread that acts in combination with a thread of the fine setting element, for the purpose of fine adjustment of a position of the housing unit relative to the seating unit. The fine setting element is preferably realized as a threaded sleeve. The fine setting element in this case can preferably be actuated by means of a control element. Fine setting of a position of the housing unit relative to the seating unit can be achieved in a structurally simple manner.

Advantageously, the shift element is realized as a single piece with the movement transforming element. "As a single piece" is to be understood to mean, in particular, connected in a materially bonded manner, for example by a welding process, an adhesive process, an injection process and/or another process considered appropriate by persons skilled in the art, and/or, advantageously, formed in one piece such as, for example, by being produced from a casting and/or by being produced in a single or multi-component injection process and, advantageously, from a single blank. It is also conceivable, however, for the shift element to be realized separately from the movement transforming element, and to be fixedly connected to the movement transforming element by means of connecting elements such as, for example, screws or rivets, etc. Advantageously, a compact disposition of the position fixing unit on the portable power tool can be achieved.

In addition, it is proposed that the portable power tool comprises at least one guide unit, which has at least one guide element, on which the shift element is disposed. The expression "guide unit" is intended here to define, in particular, a unit provided to guide a component in a movement in a plane along a defined path, by exerting at least one constraining force transversely in relation to the direction of movement. Particularly preferably, the guide unit is realized as a linear guide unit, which is provided to guide the housing unit linearly in a movement relative to the seating unit. A "constraining force" is to be understood here to mean, in particular, a force provided to prevent a component from moving in at least one direction and/or to keep the component, during a movement, on a path defined through exertion of the force upon the component. Particularly preferably, the housing unit is guided linearly along the lifting axis by means of the guide unit. A position of the housing unit can be fixed relative to the seating unit in a structurally simple manner.

Furthermore, it is proposed that the housing unit has at least one guide recess, which the movement delimitation element enters upon a movement of the housing unit in the direction of the seating unit relative to the movement delimitation unit, when the movement delimitation element is in a fixed state. Preferably, the guide recess is constituted by a cavity in the housing unit that has a shape corresponding to a shape of the movement delimitation element. Preferably, the guide recess surrounds the movement delimitation element, at least partially. Advantageously, it is possible for the movement delimitation element to be protected during a movement of the housing unit relative to the movement delimitation unit, when the movement delimitation element is in a fixed state.

The portable power tool according to the disclosure in this case is not intended to be limited to the application and embodiment described above. In particular, for the purpose of fulfilling a mode of operation described herein, the portable power tool according to the disclosure can have a number of individual elements, components and units that differs from a number stated herein.

BRIEF DESCRIPTION OF THE DRAWINGS

Further advantages are given by the following description of the drawing. The drawing shows an exemplary embodiment of the disclosure. The drawing, the description and the claims contain numerous features in combination. Persons skilled in the art will also expediently consider the features individually and combine them to create appropriate further combinations.

In the drawing.

DETAILED DESCRIPTION

Figure 1:
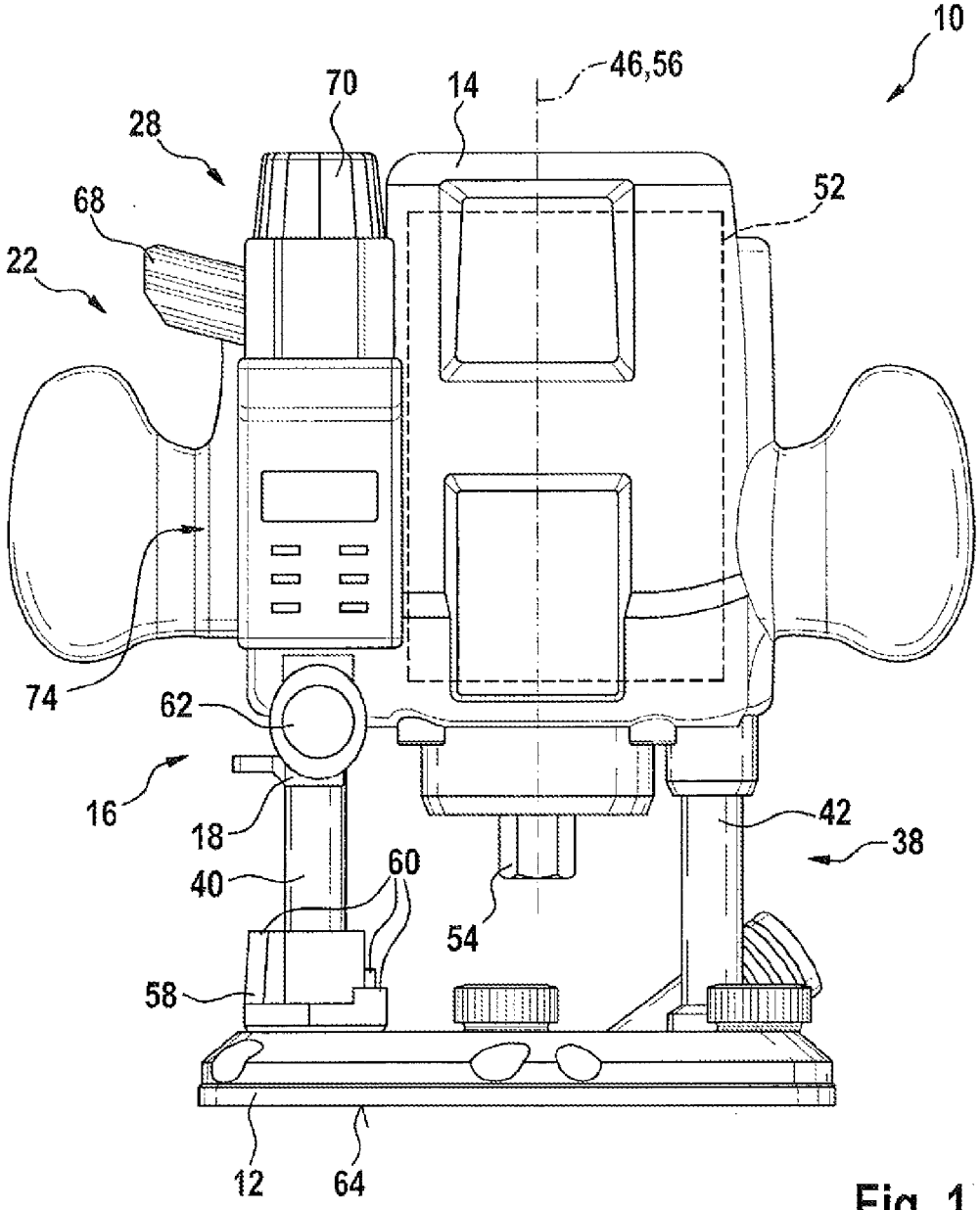
FIG. 1 shows a portable power tool according to the disclosure, in a schematic representation.

FIG. 1 shows a portable power tool 10, realized as a router, which comprises a seating unit 12 for seating on a workpiece (not represented in greater detail here), a housing unit 14, which is mounted so as to be movable relative to the seating unit 12, and a movement delimitation unit 16, which has at least one movement delimitation element 18 for setting a length of a movement travel of the housing unit 14 relative to the seating unit 12. Further, the portable power tool 10 comprises a guide unit 38, by means of which the housing unit 14 is mounted so as to be movable linearly relative to the seating unit 12. By means of the guide unit 38, the housing unit 14 is mounted so as to be movable translationally, along a lifting axis 46 of the portable power tool 10 relative to the seating unit 12. The guide unit 38 in this case comprises two guide elements 40, 42. The guide elements 40, 42, when mounted, extend at least substantially parallelwise in relation to each other. Further, the guide elements 40, 42, when mounted, extend at least substantially perpendicularly in relation to a seating surface 64 of the seating unit 12, the seating unit 12 being seated on the workpiece by means of said seating surface when a workpiece is being machined. The guide elements 40, 42 are fixedly connected to the seating unit 12 by means of a compression connection, in a manner already known to persons skilled in the art. The guide elements 40, 42 in this case are realized as hollow cylinders.

Figure 2:
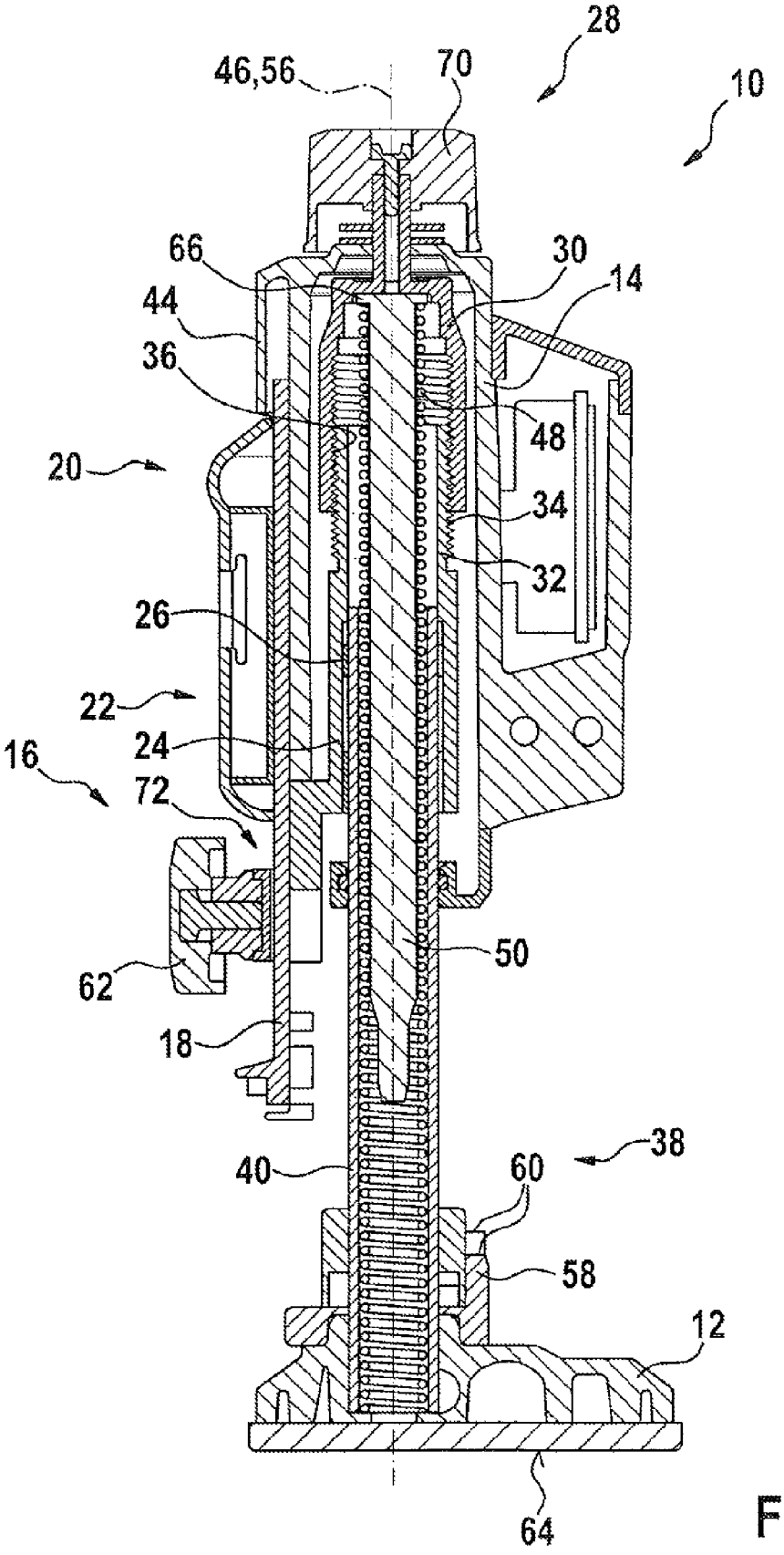
FIG. 2 shows a sectional view of the portable power tool according to the disclosure, in a schematic representation.

Further, the guide unit 38 comprises two spring elements 48 (only one spring element 48 is represented in FIG. 2). It is also conceivable, however, for the guide unit 38 to comprise a number other than two spring elements 48. The spring elements 48 are provided to apply spring forces to the housing unit 14 in a direction facing away from the seating unit 12. The spring elements 48 are disposed in the guide elements 40, 42 in a manner already known to persons skilled in the art. In addition, guide rods 50 of the guide unit 38 are disposed in the guide elements 40, 42 (only one guide rod 50 is represented in FIG. 2). The guide rods 50 in this case are surrounded by the spring elements 48. The spring elements 48 are in each case supported, via one end, on the respective guide element 40, 42 and/or on the seating unit 12 and, via another end, the spring elements 48 are each supported on a driving projection 66 of the respective guide rod 50. On a side that faces away from the seating unit 12, the guide rods 50 are each fixedly connected to the housing unit 14. The housing unit 14 is realized as a motor housing unit, in which there is disposed a drive unit 52 of the portable power tool 10. The drive unit 52 is realized as an electric motor, which is provided to drive a tool receiver 54 of the portable power tool 10. It is also conceivable, however, for the drive unit 52 to be of a different design, considered appropriate by persons skilled in the art, such as, for example, being designed as a pneumatic motor or as an internal combustion engine. The tool receiver 54 is realized as a collet chuck, which is provided to receive an insert tool (not represented in greater detail here) for machining a workpiece (not represented in greater detail here).

The movement delimitation element 18 of the movement delimitation unit 16, when mounted, extends at least substantially parallelwise in relation to a rotation axis 56 of the tool receiver 54. In addition, the movement delimitation element 18 is disposed so as to be displaceable along a direction extending at least substantially parallelwise in relation to the rotation axis 56. The movement delimitation element 18 is realized as a delimitation bar. Further, the movement delimitation element 18 can be locked in a position by means of a clamping screw 62 of the movement delimitation unit 16. When in a position locked by means of the clamping screw 62, the movement delimitation element 18 is in a fixed state. Further, the movement delimitation unit 16 comprises a revolving stop 58, which is disposed in a rotatable manner on a side of the seating unit 12 that faces toward the housing unit 14 and which, in a known manner, has stop elements 60, which are provided to realize a stop of the movement delimitation element 18 in the case of a movement of the housing unit 14 in the direction of the seating unit 12. A length of a movement travel of the housing unit 14, relative to the seating unit 12, in the direction of the seating unit 12 is set approximately, in a manner already known to persons skilled in the art, by means of a position of the movement delimitation element 18 and a position of one of the stop elements 60 of the revolving stop 58 against which the movement delimitation element 18 stops in the case of a movement of the housing unit 14 in the direction of the seating unit 12. As a result, a cutting depth of an insert tool (not represented in greater detail here) disposed in the tool receiver 54 is set approximately. The portable power tool 10, realized as a router, is thus at least substantially of a design already known to persons skilled in the art.

Furthermore, the portable power tool 10 comprises at least one position fixing unit 22, which has at least one shift element 24, on which there is disposed at least one fixing element 26 of the position fixing unit 22 for fixing the position of the housing unit 14 relative to the seating unit 12, the movement delimitation element 18 being movably mounted on the shift element 24. The shift element 24 in this case has a bearing region 72, in which the movement delimitation element 18 is mounted in a translationally movable manner. Also disposed at the bearing region 72 is the clamping screw 62 for fixing the movement delimitation element 18 in position. The shift element 24 is disposed on one of the guide elements 40, 42 of the guide unit 38. The shift element 24 in this case is disposed on one of the guide elements 40, 42 so as to be movable along a direction running substantially parallelwise in relation to the lifting axis 46. A position of the shift element 24 relative to the guide elements 40, 42 can be fixed by means of the fixing element 26. The fixing element 26 is realized as a clamping element, which can be actuated for the purpose of fixing a position of the shift element 24 on one of the guide elements 40, 42, by means of an actuating element 68 of the position fixing unit 22. The fixing element 26 is movably mounted on the shift element 24. By means of an actuation of the actuating element 68, a frictional contact is generated between the fixing element 26 and one of the guide elements 40, 42, in a manner already known to persons skilled in the art. The actuating element 68 in this case is realized as a lever. It is also conceivable, however, for the actuating element 68 to be of a different design, considered appropriate by persons skilled in the art, such as, for example, being designed as a rotary knob.

In addition, the portable power tool 10 comprises a fine setting unit 28, which has at least one fine setting element 30, which acts in combination with a movement transforming element 32 of the position fixing unit 22 for the purpose of moving the housing unit 14 relative to the seating unit 12 as a result of an actuation of the fine setting element 30. The fine setting element 30 is realized as a threaded sleeve, which can be actuated by means of a control element 70 of the fine setting unit 28. On a side that faces toward the fine setting element 30, the movement transforming element 32 has a thread 34 that acts in combination with a thread 36 of the fine setting element 30 for the purpose of fine setting of a position of the housing unit 14 relative to the seating unit 12. The movement transforming element 32 is realized as a single piece with the shift element 24.

When a workpiece is being machined by means of the portable power tool 10 for the purpose of removing particles of the workpiece, the housing unit 14 is moved, contrary to spring forces of the spring elements 48, in the direction of the seating unit 12, until a desired cutting depth, set previously by means of the movement delimitation unit 16, has been attained. As the housing unit 14 is moved in the direction of the seating unit 12, the housing unit 14 is guided by means of the guide unit 38. After the desired cutting depth has been attained, the housing unit 14 is fixed in a position, relative to the seating unit 12, by means of the position fixing unit 22. In this case, a holding force of the shift element 24 of the position fixing unit 22 that is fixed on one of the guide elements 40, 42 by means of the fixing element 26 acts upon the housing unit 14 via the fine setting element 30, which is disposed in an axially non-displaceable manner on one of the guide rods 50 and which, via the thread 36 of the fine setting element 30 and the thread 34 of the movement transforming element 32, acts in combination with the movement transforming element 32.

After a position of the housing unit 14 relative to the seating unit 12 has been fixed, the cutting depth can be readjusted, if necessary, by means of the fine setting unit 28 of the portable power tool 10. The readjustment of the cutting depth by means of the fine setting unit 28 is effected in this case at least substantially in a manner already known to persons skilled in the art. The fine setting element 30 can be actuated by means of the control element 70 of the fine setting unit 28. In this case, the fine setting element 30, realized as a threaded sleeve, is moved in the direction of the seating unit 12 or in a direction facing away from the seating unit 12 by the thread 36 of the fine setting element 30 acting in combination with the thread 34 of the movement transforming element 32. When the fine setting element 30 moves translationally, the housing unit 14 moves concomitantly, owing to the axially non-displaceable connection between the fine setting element 30, the guide rods 50 and the housing unit 14. The movement delimitation unit 16 in this case maintains a position relative to the guide elements 40, 42. The portable power tool 10 thus has at least one decoupling unit 20 provided, in at least one operating state, to decouple the movement delimitation unit 16 from a movement of the housing unit 14 when the movement delimitation element 18 is in a fixed state, at least in the case of a movement of the housing unit 14 in the direction of the seating unit 12. The decoupling unit 20 is thus constituted by the position fixing unit 22 acting in combination with the fine setting unit 28, via the thread 34 of the movement transforming element 32 and the thread 36 of the fine setting element 30, and by the disposition of the movement delimitation unit 16 on the position fixing unit 22. For the purpose of protecting the movement delimitation element 18 during a movement of the housing unit 14 relative to the movement delimitation unit 16 and relative to the position fixing unit 22, the housing unit 14 has at least one guide recess 44, which the movement delimitation element 18 enters upon a movement of the housing unit 14 in the direction of the seating unit 12 relative to the movement delimitation unit 16, when the movement delimitation element 18 is in a fixed state.

The portable power tool 10 additionally has an indicating unit 74, which is provided to indicate to an operator a cutting depth of an insert tool disposed in the tool receiver 54. The indicating unit 74 is disposed on the housing unit 14. The indicating unit 74 in this case is realized as a digital indicating unit 74. It is also conceivable, however, for the indicating unit 74 to be of a different design, considered appropriate by persons skilled in the art, such as, for example, being designed as an analog indicating unit. Owing to a decoupling of the movement delimitation unit 16 from a movement of the housing unit 14 in the case of a movement of the housing unit 14 in the direction of the seating unit 12, a movement of the housing unit 14 relative to the seating unit 12 and relative to the movement delimitation unit 16 is reliably registered and a cutting depth corresponding exactly to the movement is indicated by means of the indicating unit 74 in the case of a readjustment through an actuation of the fine setting unit 28, in particular in the case of the movement delimitation element 18 bearing against one of the stop elements 60 of the revolving stop 58.

What is claimed is:

1. A portable power tool, comprising:

at least one seating unit configured to seat on a workpiece;

at least one housing unit mounted so as to be movable relative to the seating unit;

at least one movement delimitation unit having at least one movement delimitation element configured to set a length of a movement travel of the housing unit relative to the seating unit; and at least one decoupling unit configured to decouple the movement delimitation unit from movement of the housing unit in at least one operating state in which the movement delimitation element is in a fixed state relative to the seating unit and the housing unit is moved in a direction toward the seating unit, wherein the decoupling unit includes a position fixing unit comprising (i) a shift element, on which the movement delimitation element is movably mounted, and (ii) at least one fixing element disposed on the shift element, the fixing element being configured to selectively fix a position of the housing unit relative to the seating unit.

2. The portable power tool according to claim 1, wherein:

the decoupling unit further includes at least one fine setting unit having at least one fine setting element, the position fixing unit includes a movement transforming element, and the at least one fine setting element acts in combination with the movement transforming element to move the housing unit relative to the seating unit in response to an actuation of the fine setting element.

3. The portable power tool according to claim 2, wherein:

the movement transforming element has a first thread, the fine setting element includes a second thread, and the first and second threads act in combination with one another for fine adjustment of a position of the housing unit relative to the seating unit.

4. The portable power tool according to claim 2, wherein the shift element is integrally formed as a single piece with the movement transforming element.

5. The portable power tool according to claim 1, further comprising at least one guide unit having at least one guide element on which the shift element is disposed.

6. The portable power tool according to claim 1, wherein the housing unit has at least one guide recess, which the movement delimitation element enters upon movement of the housing unit relative to the movement delimitation unit in the direction of the seating unit when the movement delimitation element is in the fixed state.

7. The portable power tool according to claim 1, wherein the portable power tool is a router.

8. The portable power tool according to claim 5, wherein the at least one guide unit is fixedly connected to the seating unit, and the fixing element is configured to engage the at least one guide unit to fix a position of the shift element relative to the seating unit.

9. The portable tool according to claim 8, wherein the fixing element frictionally engages the at least one guide unit to fix the position of the housing unit relative to the seating unit.

* * * * *